US006102780A

United States Patent [19]

Ishimaru

[11] Patent Number: 6,102,780

[45] Date of Patent: Aug. 15, 2000

[54] SUBSTRATE POLISHING APPARATUS AND METHOD FOR POLISHING SEMICONDUCTOR SUBSTRATE

[75] Inventor: Makoto Ishimaru, Tokyo, Japan

[73] Assignee: Oki Electric Industry Co., Ltd., Tokyo, Japan

[21] Appl. No.: 09/198,525

[22] Filed: Nov. 24, 1998

[30] Foreign Application Priority Data

Apr. 9, 1998 [JP] Japan ..... 10-097508

[51] Int. Cl.[7] ..... B24B 1/00

[52] U.S. Cl. ..... 451/41; 451/285

[58] Field of Search ..... 451/7, 41, 58, 451/53, 63, 285, 286, 287, 288, 398, 384

[56] References Cited

U.S. PATENT DOCUMENTS

| | | | |
|---|---|---|---|
| 4,165,584 | 8/1979 | Scherrer | 51/131.1 |
| 5,191,738 | 3/1993 | Nakazato et al. | 51/283 R |
| 5,664,988 | 9/1997 | Stroupe et al. | 451/41 |

FOREIGN PATENT DOCUMENTS

| | | |
|---|---|---|
| 3-19336 | 1/1991 | Japan . |
| 6-198560 | 7/1994 | Japan . |
| 6-210563 | 8/1994 | Japan . |

*Primary Examiner*—Timothy V. Eley
*Assistant Examiner*—Dung Van Nguyen
*Attorney, Agent, or Firm*—Wenderoth, Lind & Ponack, L.L.P.

[57] ABSTRACT

A substrate polishing apparatus is provided with: a turntable (36) having a polishing surface; a plate (11) having an attaching surface to which GaAs semiconductor wafers (12*a* through 12*d*) are attached; points (42*a* through 42*d*) for adjusting the gap between the GaAs semiconductor wafers (12*a* through 12*d*) attached to the plate (11) and the polishing surface of the turntable (36); and notches (16*a* through 16*d*) formed so that they extend from the portions of the plate (11), where the points (42*a* through 42*d*) are formed, to the circumference of the plate (11). A method for polishing a semiconductor substrate employs the substrate polishing apparatus.

27 Claims, 4 Drawing Sheets

SUBSTRATE POLISHING APPARATUS AND METHOD FOR POLISHING SEMICONDUCTOR SUBSTRATE

BACKGROUND OF THE INVENTION

1. Field of the Invention

The present invention relates to a substrate polishing apparatus used in the process for polishing a semiconductor wafer and a method for polishing the semiconductor wafer by using the substrate polishing apparatus.

2. Description of Related Art

The apparatus and the polishing method described below have been proposed as a substrate polishing apparatus and a method for polishing a semiconductor wafer by using the substrate polishing apparatus.

First, a semiconductor wafer is secured to a polishing plate via wax by melting the wax applied to the polishing plate by exposing it to a high-temperature atmosphere. An abrasive is supplied onto a turntable and the polishing plate presses a semiconductor wafer against the turntable. The polishing amount of the semiconductor wafer is adjusted by height adjusting points provided on the polishing plate. Thus, the semiconductor wafer is polished.

SUMMARY OF THE INVENTION

It is an object of the present invention to provide a substrate polishing apparatus that enables the deformation of a plate to be restrained even if it is repeatedly used, and a method for polishing a semiconductor wafer by using the substrate polishing apparatus.

To this end, according to the present invention, there is provided a substrate polishing apparatus in which a polishing plate, to which a semiconductor wafer is to be secured, is provided with notches or grooves extending inward from the circumference thereof. This substrate polishing apparatuses is used to polish a semiconductor wafer.

DESCRIPTION OF THE PREFERRED EMBODIMENTS (First Embodiment)

Figure 1A:
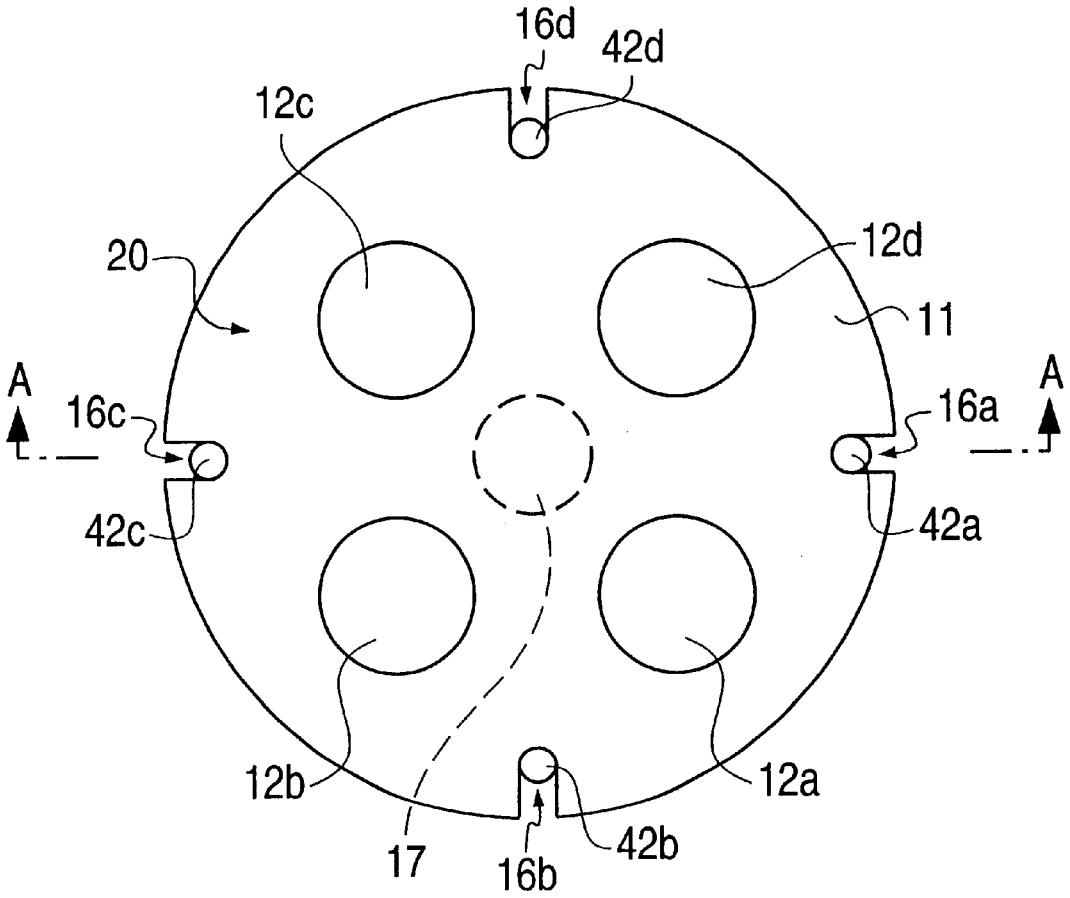
FIG. 1A and FIG. 1B are a sectional view and a top plan view, respectively, of a substrate polishing jig showing a first embodiment of the present invention.
Figure 1B:
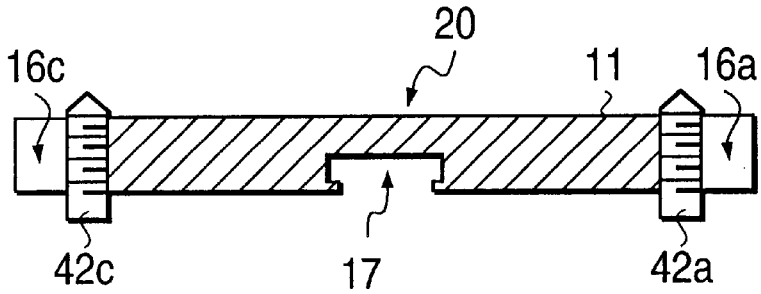
Figure 1C:
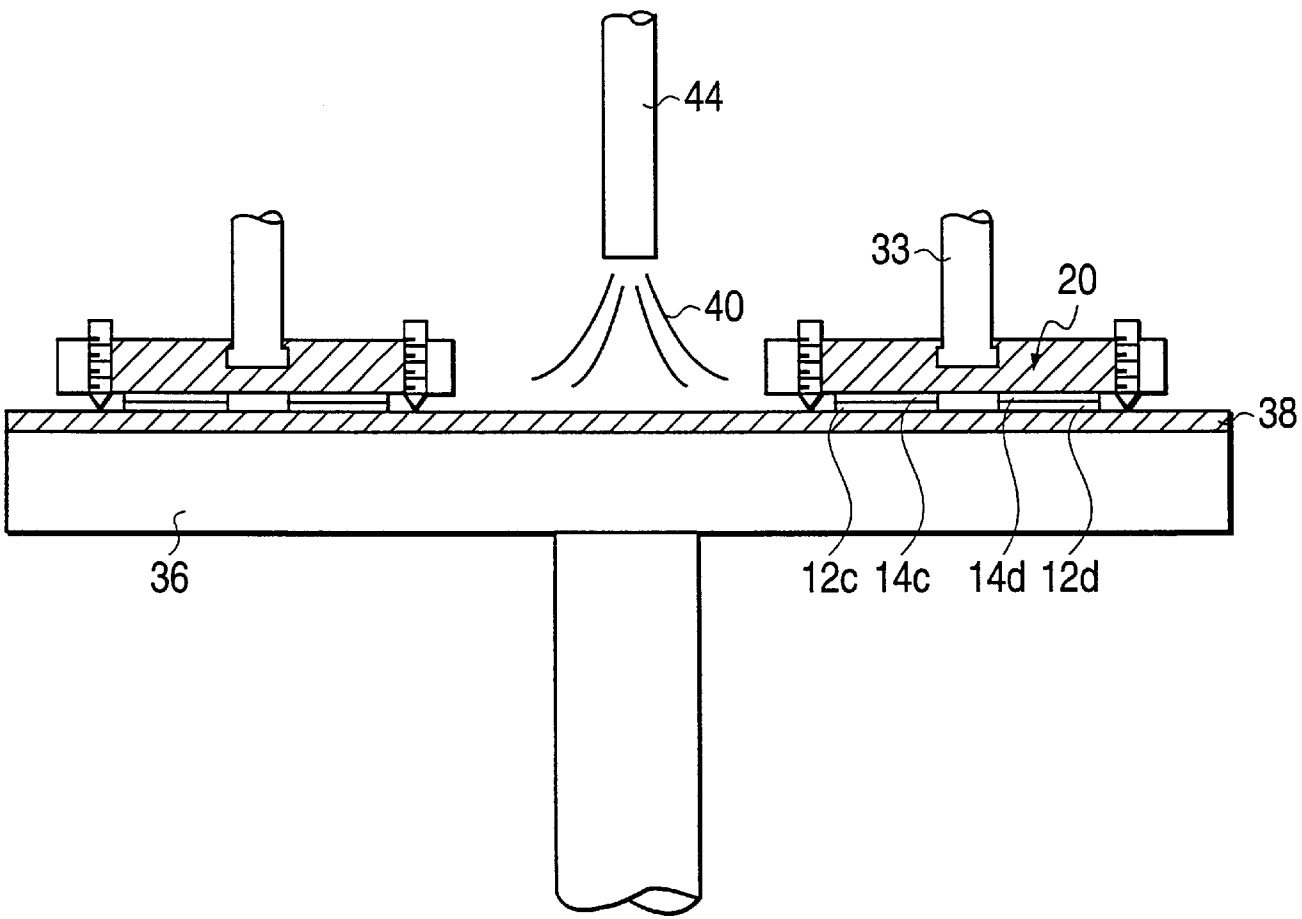
FIG. 1C is a sectional view of a substrate polishing apparatus showing the first embodiment of the present invention.

FIG. 1A and FIG. 1B show a substrate polishing jig in a substrate polishing apparatus showing a first embodiment of the present invention. FIG. 1C shows the substrate polishing apparatus illustrative of the first embodiment of the present invention.

A substrate polishing jig 20 has a plate 11 that is made of light-transmitting, heat-resistant glass (Soda-lime glass having a thermal expansion coefficient of 10.7×10−6/K) and that is provided with points 42*a* through 42*d* serving as the polishing amount adjusting means for making height adjustment of the substrate polishing jig 20 above the polishing surface of a turntable 36, four notches 16*a* through 16*d* formed so that they extend from the points 42*a* through 42*d* to the circumference of the substrate polishing jig 20, and an attaching surface to which GaAs semiconductor wafers 12*a* through 12*d* are to be attached.

The four notches 16*a* through 16*d* function to prevent warp or other deformation of the plate 11 itself caused by repeated expansion and contraction and to relieve the stress applied to the plate 11 by the thermal expansion of the points 42*a* through 42*d* provided in the notches 16*a* through 16*d*. The inner surfaces of the distal end portions of the four notches 16*a* through 16*d* are threaded although the threaded portions are not shown. The threaded portions threadedly engage with the points 42*a* through 42*d* to hold the points 42*a* through 42*d* at a predetermined height.

The points 42*a* through 42*d* are screw members composed of Ti having a thermal expansion coefficient of 10.0×10−6/K that is close to the thermal expansion coefficient of the plate 11. The distal end of each of the points 42*a* through 42*d* is provided with diamond, not shown, and all the points 42*a* through 42*d* are adjusted to jut out from the surface of the plate 11 at the same height.

The plate 11 is provided with a groove 17 for connection with a shaft 33, which is a part of a pressing rotary mechanism that presses the plate 11 while turning it. The groove 17 is located at the center of the opposite surface from the surface where the GaAs wafers 12*a* through 12*d* are attached.

To paste the GaAs wafers onto the substrate polishing jig 20, the substrate polishing jig 20 is first heated to 60 degrees Celsius. At this time, the plate 11 and the points 42*a* through 42*d* expand. Since the points 42*a* through 42*d* use Ti, as the material thereof, that has the thermal expansion coefficient close to that of the plate 11, the points 42*a* through 42*d* expand at a similar rate to that of the plate 11. Hence, the expansion of the points 42*a* through 42*d* does not cause high stress to the plate 11. In addition, the plate 11 itself has the notches 16*a* through 16*d* that allow the plate 11 to expand without undue stress applied thereto.

After heating the plate 11 to 60 degrees Celsius, the four GaAs wafers 12*a* through 12*d* with wax spots 14*a* through 14*d* applied to the back surfaces thereof are placed on the attaching surface of the plate 11 in good balance. Then, the wax spots 14*a* through 14*d* on the back surfaces of the GaAs wafers 12*a* through 12*d* are melted once and cooled. At this time, the points 42*a* through 42*d* and the plate 11 go back to their original sizes. However, the plate 11 is not subjected to high stress because the points 42*a* through 42*d* and the plate 11 both go back to their original sizes at a similar rate. In addition, the notches 16*a* through 16*d* provided in the plate 11 permit the plate 11 to restore its original size without undue stress applied thereto.

Thus, the plate 11 can be repeatedly expanded and contracted without undue stress applied thereto even when it is thermally expanded repeatedly by the substrate polishing jig 20 in accordance with the first embodiment; therefore, the plate 11 does not develop warps or cracks and the flatness of the plate 11 can be maintained for an extended period of time.

Since the plate is composed of the heat-resistant glass, which is a transparent material, whether the wax has been applied evenly to the back surfaces of the semiconductor wafers, whether air bubbles are in the wax spots, or other conditions of the applied wax spots can be visually checked. This makes it possible to eliminate the danger of starting the polishing process with a poorly applied wax condition uncorrected.

To polish the GaAs wafers 12*a* through 12*d* (the four semiconductor wafers are held) by using the substrate polishing jig 20, the GaAs wafers 12*a* through 12*d* (only 12*c* and 12*d* are shown in FIG. 1C) are attached, using the wax spots 14*a* through 14*d* (only 14*c* and 14*d* are shown in FIG. 1C), on the attaching surface of the plate 11 constituting the substrate polishing jig 20.

Next, the height of all the points 42*a* through 42*d* is adjusted so that it is the same as the thickness of the polished GaAs wafers 12*a* through 12*d*. Then, the plate 11 to which the GaAs wafers 12*a* through 12*d* have been attached is installed to the shaft 33.

After installing the plate 11 to the shaft 33, the shaft 33 is adjusted so that the plate 11 and the turntable 36 are disposed precisely in parallel. After that, the turntable 36 and the shaft 33 are respectively rotated at predetermined rpms while supplying an abrasive 40, which contains Al2O3 (alumina) through an abrasive solution supply nozzle 44, between the turntable 36 and the substrate polishing jig 20. As the shaft 33 is moved down toward the turntable 36, the GaAs wafers 12*a* through 12*d* attached to the plate 11 in connection with the shaft 33 are pressed against polishing cloth 38 glued to the turntable 36 so that they are polished.

As the GaAs wafers 12*a* through 12*d* are polished, the GaAs wafers 12*a* through 12*d* gradually grow thinner. When the polished surfaces of the GaAs wafers 12*a* through 12*d* become flush with the surface including the apexes of the points 42*a* through 42*d*, the points 42*a* through 42*d* come in contact with the polishing cloth 38 on the surface of the turntable 36, preventing the plate 11 from moving down any further. This stops the polishing of the GaAs wafers 12*a* through 12*d*, thus finishing the polishing process of the GaAs wafers 12*a* through 12*d*.

In the first embodiment, the present invention has been applied to the substrate polishing apparatus for polishing one surface. The present invention, however, is not limited to the substrate polishing apparatus for polishing one surface; it can be also applied to a substrate polishing apparatus for polishing both surfaces.

(Second Embodiment)

Figure 2A:
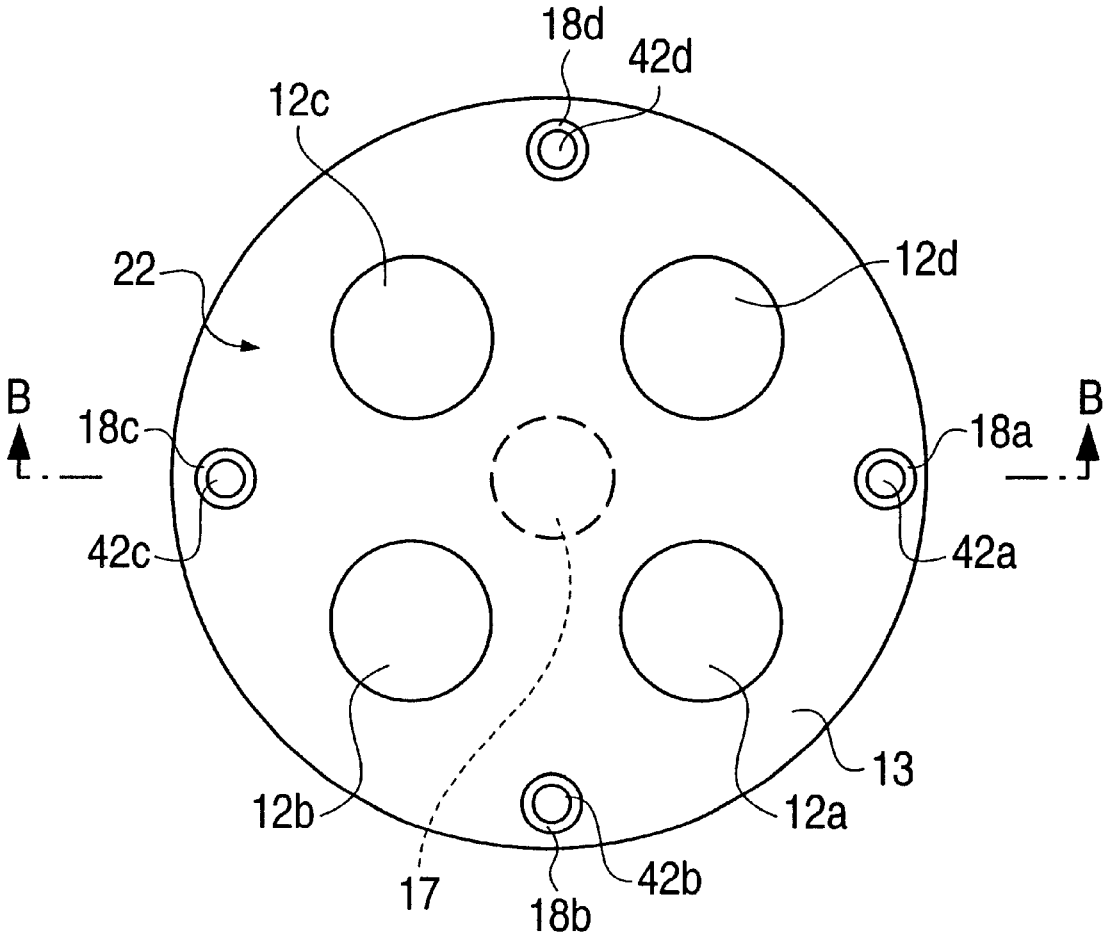
FIG. 2A and FIG. 2B are a sectional view and a top plan view, respectively of a substrate polishing jig showing a second embodiment of the present invention.
Figure 2B:
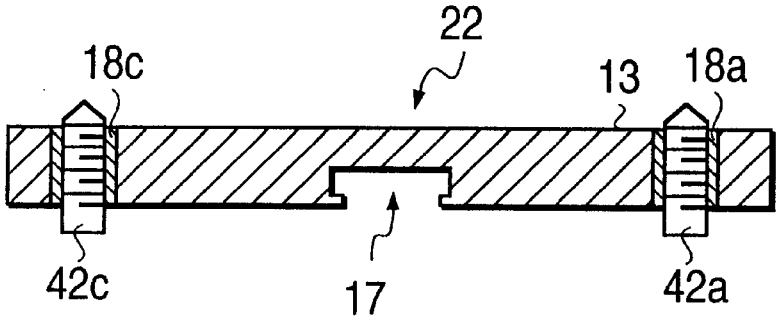

A substrate polishing jig 22 of a second embodiment is constituted by: an attaching surface to which GaAs semiconductor wafers 12*a* through 12*d* are to be glued, cylindrical members 18*a* through 18*d* (stress alleviating means) that are provided on the portions threadedly engaged with SUS points 42*a* through 42*d* serving as polishing amount adjusting means and that are made of Ti having a thermal expansion coefficient 10.0×10−6/K, a plate 13 made of transparent, heat-resistant glass composed of soda-lime glass having a thermal expansion coefficient of 10.7×10−6/K, and SUS points threadedly engaged with the cylindrical members 18*a* through 18*d* as shown in FIGS. 2A and 2B.

The cylindrical members 18*a* through 18*d* are composed of a metal material having a thermal expansion coefficient close to that of the plate 13. Hence, when the cylindrical members 18*a* through 18*d* are heated together with the plate 13, they do not thermally expand more than the plate 13 does, thereby to cause undue stress to be applied to the plate 13. Further, even when the SUS points 42*a* through 42*d* supported by the cylindrical members 18*a* through 18*d* thermally expand considerably to apply stress to the cylindrical members 18*a* through 18*d*, the cylindrical members 18*a* through 18*d* do not develop marked deformation. Therefore, it is possible to prevent the stress caused by the expansion of the SUS points 42*a* through 42*d* from being transferred to the plate through the cylindrical members 18*a* through 18*d*. Thus, the deformation or cracks of the plate can be prevented.

The points 42*a* through 42*d* are screw members composed of SUS. The distal end of each of the points 42*a* through 42*d* are provided with a diamond point (not shown) and the points 42*a* through 42*d* are all adjusted so that they jut out from the surface of the plate 13 at the same height.

The rest of the constitution is identical to the constitution of the first embodiment; therefore, like reference numerals will be assigned and the description thereof will be omitted. The substrate polishing jig 22 of the second embodiment is applied to the substrate polishing apparatus having the construction shown in FIG. 1C.

Thus, in the substrate polishing jig 22 according to the second embodiment, even if the points 42*a* through 42*d* for controlling the polishing amount thermally expand more than the plate 13 does when the plate 13 is heated, the cylindrical members 18*a* through 18*d* provided on the plate 13 alleviate the stress caused by the expansion of the points 42*a* through 42*d*. This prevents undue stress from being applied to the plate 15. Hence, it is possible to eliminate the danger of the deformation such as warp or cracks of the plate 13 attributable to the thermal expansion of the points 42*a* through 42*d*, allowing the flatness of the plate 13 to be maintained for a prolonged period of time.

(Third Embodiment)

Figure 3A:
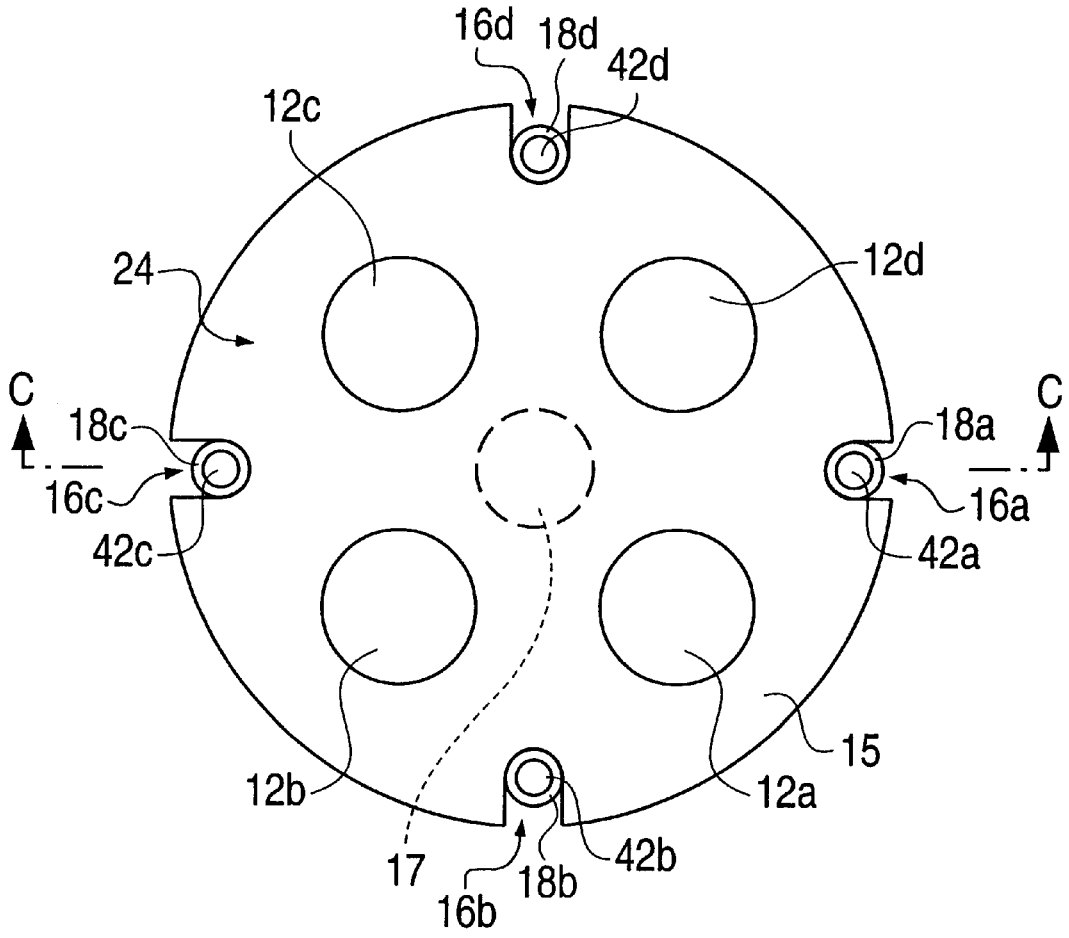
FIG. 3A and 3B are a sectional view and a top plan view, respectively of a substrate polishing jig showing a third embodiment of the present invention.
Figure 3B:
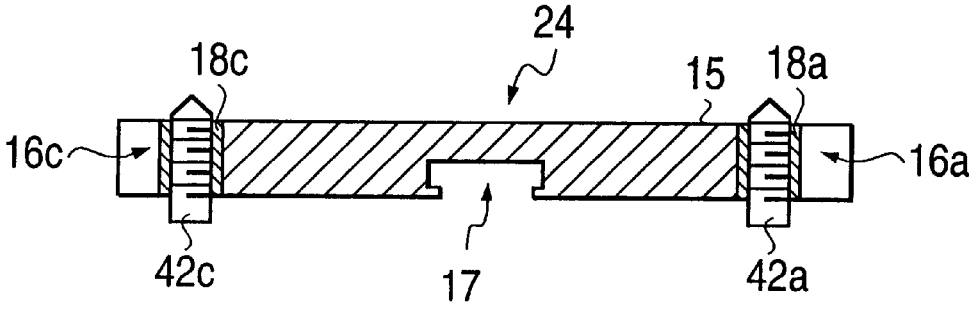

As shown in FIG. 3A and FIG. 3B, a substrate polishing jig 24 of a third embodiment is constituted by a plate 15 provided with four notches 16*a* through 16*d*, which are formed symmetrically and which extend inward from the circumference of the plate 15, and cylindrical members 18*a* through 18*d* (stress alleviating means) which are provided on the inner distal end portions of the notches 16*a* through 16*d* and which are composed of Ti having a thermal expansion coefficient of 10.0×10−6/K, and SUS points 42*a* through 42*d* supported by the cylindrical members 18*a* through 18*d*. The portions of the cylindrical members 18*a* through 18*d* are internally threaded, while the points 42*a* through 42*d* are externally threaded.

As described in the first embodiment above, the four notches 16*a* through 16*d* provided in the plate 15 allow the plate 15 to expand without undue stress applied thereto when the substrate polishing jig 24 is heated to 60 degrees Celsius to paste the GaAs wafers. Thus, even when the substrate polishing jig 24 is used many times to cause thermal expansion repeatedly, the plate 15 is allowed to repeat expansion and contraction without undue stress being applied thereto. This prevents the plate 15 from developing warps or cracks, permitting the flatness of the plate 15 to be maintained for an extended period of time.

Further, as described in the second embodiment above, the cylindrical members 18*a* through 18*d* provided on the inner surfaces of the distal end portions of the notches 16*a* through 16*d* are made of a metal material having a thermal expansion coefficient close to that of the plate i5. Accordingly, when the cylindrical members 18*a* through 18*d* are heated together with the plate 15, they do not thermally expand more than the plate 15 does, thereby to cause undue stress to be applied to the plate 15. Further, even when the SUS points 42*a* through 42*d* supported by the cylindrical members 18*a* through 18*d* thermally expand considerably to apply stress to the cylindrical members 18*a* through 18*d*, the plate 15 is not markedly deformed. Therefore, it is possible to prevent the stress caused by the expansion of the SUS points 42*a* through 42*d* from being transferred to the plate 15 through the cylindrical members 18*a* through 18*d*. Thus, the deformation or cracks of the plate 15 can be prevented.

The rest of the constitution is identical to the constitutions of the first and second embodiments; therefore, like reference numerals will be assigned and the description thereof will be omitted. The substrate polishing jig 24 of the third embodiment is applied to the substrate polishing apparatus having the construction shown in FIG. 1C.

Thus, in the substrate polishing jig 24 according to the third embodiment, the plate 15 does not develop warps or cracks since the plate 15 is allowed to repeatedly expand and contract without undue stress applied thereto even when the substrate polishing jig 24 is used many times to repeat the thermal expansion. This permits the flatness of the plate 15 to be maintained for an extended period of time. Further, even if the points 42*a* through 42*d* for controlling the polishing amount thermally expand more than the plate 15 does, the cylindrical members 18*a* through 18*d* provided on the plate 15 alleviate the stress caused by the expansion of the points 42*a* through 42*d*. This prevents undue stress from being applied to the plate 13. Hence, it is possible to eliminate the danger of the deformation such as warp or cracks of the plate 15 attributable to the thermal expansion of the points 42*a* through 42*d*, allowing the flatness of the plate 15 to be maintained for a prolonged period of time also from this viewpoint.

In the first through third embodiments, since the plate is composed of the heat-resistant glass, which is a transparent material, whether the wax has been applied evenly to the back surfaces of the semiconductor wafers, whether air bubbles are in the wax spots, or other conditions of the applied wax can be visually checked. This makes it possible to eliminate the danger of starting the polishing process with a poorly applied wax condition uncorrected.

If the plate is composed of a material such as heat-resistant glass so that it is lighter than an Al or SUS plate, then it permits easier handling such as removal for its lighter weight. Especially in case of a plate for wafers with larger diameters, the diameter of the plate accordingly is larger than that of a plate for regular semiconductor wafers; hence, the plate will be much lighter than the Al or SUS plate. This leads to an advantage in that the handling such as removal of the plate will be easier with consequent easier operation and higher safety.

In the first through third embodiments, the heat-resistant glass has been used for the plate. The material for the plate, however, is not limited to the heat-resistant glass; it may be other transparent material such as quartz. Further, in the first through third embodiments, the material of the plate may be Al or SUS.

In the first through third embodiments, the composition for polishing semiconductor wafers has been described as an example. The present invention, however, is not limited to the apparatus for polishing semiconductor wafers; it may be applied to an apparatus for polishing any flat plate-shaped base materials.

Furthermore, in the first through third embodiments, the points are supported on the inner surfaces of the distal end portions of the notches. The positions where the points are supported, however, are not necessarily supported in the notches; the positions where the notches are formed may be separate from the positions where the points are supported.

Moreover, in the first through third embodiments, the externally threaded points have been used as an example of the polishing amount adjusting means. The polishing amount adjusting means, however, may be any other means as long as it permits accurate adjustment of the jutting height from the plate; for example, it may be a pin or other component.

In the present invention, it is preferable that the difference in thermal expansion coefficient among the plate member such as the plate, the polishing amount adjusting means such as the points, and the stress alleviating means such as the cylindrical members referred to in the first through third embodiments is within the range of approximately ±15%.

What is claimed is:

1. A substrate polishing apparatus comprising:

a plate on which a semiconductor substrate is to be set;

a notch formed in said plate so that it extends inward from the circumference of said plate;

a turntable having a polishing surface for polishing the semiconductor substrate; and polishing amount adjusting means that is provided on said plate and that adjusts a gap between the semiconductor substrate set on said plate and said polishing surface of said turntable;

wherein the thermal expansion coefficient of said polishing amount adjusting means is substantially identical to the thermal expansion coefficient of said plate.

2. A substrate polishing apparatus according to claim 1, wherein said plate is made of a light-transmitting material.

3. A substrate polishing apparatus comprising:

a plate on which a semiconductor substrate is to be set; a notch formed in said plate so that it extends inward from the circumference of said plate;

a turntable having a polishing surface for polishing the semiconductor substrate; and polishing amount adjusting means that is provided on said plate and that adjusts a gap between the semiconductor substrate set on said plate and said polishing surface of said turntable;

wherein the thermal expansion coefficient of said polishing amount adjusting means is substantially identical to the thermal expansion coefficient of said plate.

4. A substrate polishing apparatus according to claim 3, wherein said plate is made of a light-transmitting material.

5. A substrate polishing apparatus comprising:

a plate on which a semiconductor substrate is to be set;

a notch formed in said plate so that it extends inward from the circumference of said plate;

a turntable having a polishing surface for polishing the semiconductor substrate;

polishing amount adjusting means that is provided on said plate and that adjusts a gap between the semiconductor substrate set on said plate and said polishing surface of said turntable; and stress alleviating means that is provided in said plate to support said polishing amount adjusting means.

6. A substrate polishing apparatus according to claim 5, wherein said stress alleviating means is formed in a cylindrical shape and located in said plate to support said polishing amount adjusting means.

7. A substrate polishing apparatus according to claim 5, wherein said notch is formed so that it extends to said stress alleviating means from the circumference of said plate.

8. A substrate polishing apparatus according to claim 5, wherein the thermal expansion coefficient of said stress alleviating means is substantially identical to the thermal expansion coefficient of said plate.

9. A substrate polishing apparatus according to claim 5, wherein said plate is made of a light-transmitting material.

10. A substrate polishing apparatus comprising:

a plate on which a semiconductor substrate is to be set;

a turntable having a polishing surface for polishing said semiconductor substrate;

polishing amount adjusting means that is provided on said plate and that adjusts a gap between the semiconductor substrate set on said plate and said polishing surface of said turntable; and stress alleviating means that is provided between said polishing amount adjusting means and said plate and that supports said polishing amount adjusting means.

11. A substrate polishing apparatus according to claim 10, wherein said stress alleviating means is formed in a cylindrical shape and located in said plate to support said polishing amount adjusting means.

12. A substrate polishing apparatus according to claim 10, wherein the thermal expansion coefficient of said stress alleviating means is substantially identical to the thermal expansion coefficient of said plate.

13. A substrate polishing apparatus according to claim 10, wherein said plate is made of a light-transmitting material.

14. A method for polishing a semiconductor substrate comprising:

setting a semiconductor substrate on a plate;

adjusting a gap between said semiconductor substrate and a polishing surface of a turntable by using a polishing amount adjusting means equipped on said plate;

alleviating stress by stress alleviating means that is provided between said polishing amount adjusting means and said plate and that supports said polishing amount adjusting means; and polishing said semiconductor substrate by using said polishing surface of said turntable.

15. A substrate polishing apparatus comprising:

a plate on which a semiconductor substrate is to be set;

a notch formed in said plate so that it extends inward from the circumference of said plate;

a turntable having a polishing surface for polishing the semiconductor substrate; and polishing amount adjuster that is provided on said plate and that adjusts a gap between the semiconductor substrate set on said plate and said polishing surface of said turntable;

wherein the thermal expansion coefficient of said polishing amount adjuster is substantially identical to the thermal expansion coefficient of said plate.

16. A substrate polishing apparatus according to claim 15, wherein said plate is made of a light-transmitting material.

17. A substrate polishing apparatus comprising:

a plate on which a semiconductor substrate is to be set;

a notch formed in said plate so that it extends inward from the circumference of said plate;

a turntable having a polishing surface for polishing the semiconductor substrate; and polishing amount adjuster that is provided on said plate and that adjusts a gap between the semiconductor substrate set on said plate and said polishing surface of said turntable;

wherein the thermal expansion coefficient of said polishing amount adjuster is substantially identical to the thermal expansion coefficient of said plate.

18. A substrate polishing apparatus according to claim 17, wherein said plate is made of a light-transmitting material.

19. A substrate polishing apparatus comprising:

a plate on which a semiconductor substrate is to be set;

a notch formed in said plate so that it extends inward from the circumference of said plate;

a turntable having a polishing surface for polishing the semiconductor substrate;

polishing amount adjuster that is provided on said plate and that adjusts a gap between the semiconductor substrate set on said plate and said polishing surface of said turntable; and stress alleviator that is provided in said plate to support said polishing amount adjuster.

20. A substrate polishing apparatus according to claim 19, wherein said stress alleviator is formed in a cylindrical shape located in said plate to support said polishing amount adjuster.

21. A substrate polishing apparatus according to claim 19, wherein said notch is formed so that it extends to said stress alleviator from the circumference of said plate.

22. A substrate polishing apparatus according to claim 19, wherein the thermal expansion coefficient of said stress alleviator is substantially identical to the thermal expansion coefficient of said plate.

23. A substrate polishing apparatus according to claim 19, wherein said plate is made of a light-transmitting material.

24. A substrate polishing apparatus comprising:

a plate on which a semiconductor substrate is to be set;

a turntable having a polishing surface for polishing said semiconductor substrate;

polishing amount adjuster that is provided on said plate and that adjusts a gap between the semiconductor substrate set on said plate and said polishing surface of said turntable; and stress alleviator that is provided between said polishing amount adjuster and said plate and that supports said polishing amount adjuster.

25. A substrate polishing apparatus according to claim 24, wherein said stress alleviator is formed in a cylindrical shape and located in said plate to support said polishing amount adjuster.

26. A substrate polishing apparatus according to claim 24, wherein the thermal expansion coefficient of said stress alleviator is substantially identical to the thermal expansion coefficient of said plate.

27. A substrate polishing apparatus according to claim 24, wherein said plate is made of a light-transmitting material.

* * * * *